United States Patent [19]

Stude

[11] Patent Number: 4,960,284

[45] Date of Patent: Oct. 2, 1990

[54] LACROSSE PRACTICE GOAL ASSEMBLY

[76] Inventor: Rodney C. Stude, 8163 E. Mineral Dr., Englewood, Colo. 80112

[21] Appl. No.: 416,956

[22] Filed: Oct. 4, 1989

[51] Int. Cl.[5] ..... A63B 69/00; F41J 1/00

[52] U.S. Cl. ..... 273/395

[58] Field of Search ..... 273/395, 396, 181 F, 273/411

[56] References Cited

U.S. PATENT DOCUMENTS 3,013,801 12/1961 Kirkconnell, Jr. ..... 273/181 F
4,063,739 12/1977 La Rose ..... 273/181 F
4,842,284 6/1989 Rushing et al. ..... 273/395

FOREIGN PATENT DOCUMENTS 934599 8/1963 United Kingdom ..... 273/181 F

OTHER PUBLICATIONS

"Carron Net" 1989 Catalog of the Carron Net Company, Inc., P.O. Box 177, Two Rivers, WI 54241.

*Primary Examiner*—William H. Grieb
*Attorney, Agent, or Firm*—Bruce G. Klaas; William P. O'Meara

[57] ABSTRACT

A lacrosse practice goal assembly including: a generally planar, vertically disposed net; first and second vertically disposed posts, having predetermined flexural characteristics, for supporting the net at lateral side edges thereof; and an anchor assembly for anchoring the first and second posts to a base surface.

13 Claims, 1 Drawing Sheet

LACROSSE PRACTICE GOAL ASSEMBLY

BACKGROUND OF THE INVENTION

The present invention relates generally to lacrosse equipment and, more particularly, to a lacrosse practice goal.

Lacrosse is an athletic team sport similar to soccer and ice hockey in which players score by "shooting" a ball through an opponent's goal opening. An official lacrosse goal opening is a vertically upright, planar area having a height of six feet and a lateral dimension of six feet.

A lacrosse goal opening is defined by a lacrosse goal assembly which is formed from a heavy metal frame (typically rigid, one-inch diameter steel pipe) and high-strength net material. The frame assembly comprises two vertical post members which are welded or otherwise connected at an upper end thereof to a horizontal cross member. These three members define the goal plane. A triangular base is formed by two horizontal members which are connected at a point behind the goal plane. The vertical post members are fixedly attached to forward ends of the triangular base. Diagonal members extending between the upper ends of the vertical post members and the connection point of the base members complete the lacrosse goal assembly frame. A relatively heavy net is attached at the rear and lateral sides of the goal assembly frame so as to retain the lacrosse ball after a goal has been scored. Thus, conventional lacrosse goal assemblies are large, heavy, rigid-frame assemblies which are not readily transportable. Such goal assemblies are relatively expensive, typically costing on the order of $150.00 and weighing 48 pounds.

Each lacrosse player carries a lacrosse stick which has a pocket-forming net at one end thereof. Basic lacrosse skills include use of a lacrosse stick to (1) catch a thrown ball while it is in the air; (2) catch a bouncing ball; (3) scoop a ball from the ground; (4) throw or "pass" a ball to another player; and (5) throw or "shoot" a ball into an opponent's goal.

In order to practice lacrosse shooting skills, many players purchase their own lacrosse goal assemblies, erecting them in backyards, etc. Practicing shooting skills with an actual lacrosse goal is significantly more effective than, for example, throwing a lacrosse ball against a delineated area on a wall or backboard since the lacrosse ball, when "shot" is thrown at a high velocity and thus comes off a backboard with such velocity as to make ball retrieval a time-consuming and annoying detraction. However, even when an actual lacrosse goal assembly is used to practice shooting skills, the practicing individual must still move from his shooting position to the goal to retrieve the lacrosse ball after each shot. Passing and catching skills are usually practiced with a partner. In order to practice ball catching skills by oneself, an individual must generally find a suitable backboard in order to mimic the conditions actually encountered in a lacrosse match. A conventional lacrosse goal assembly is of no assistance in practicing passing and catching skills by one's self.

OBJECTS OF THE INVENTION

It is an object of the present invention to provide a lacrosse practice goal assembly which facilitates practice of basic lacrosse skills including scooping, catching, passing, and shooting of a lacrosse ball.

It is another object of the present invention to provide a lacrosse practice goal assembly which is lightweight, e.g. eight pounds, and readily transportable and which may be easily and quickly erected or disassembled by a single individual.

It is another object of the present invention to provide a lacrosse practice goal assembly which is relatively inexpensive to produce.

It is another object of the present invention to provide a lacrosse practice goal assembly which is adapted to receive a lacrosse shot, dissipate energy therefrom, and return the lacrosse ball in the general direction of the player making the shot.

It is another object of the present invention to provide a lacrosse practice goal assembly having a net which receives and returns goal shots from both a front surface and a back surface thereof.

It is another object of the present invention to provide a lacrosse practice goal assembly which may be erected and used indoors as well as outdoors.

SUMMARY OF THE INVENTION

The present invention may comprise a lacrosse practice goal assembly comprising: a generally planar, vertically disposed net having a first lateral side edge, a second lateral side edge, a top edge and a bottom edge; a first vertically disposed post means for supporting said net at said first lateral side edge thereof; a second vertically disposed post means for supporting said net at said second lateral side edge thereof; anchor means for anchoring said first and second post means to a base surface; said first and second vertical post means each comprising a rod member having a central longitudinal axis and having flexural characteristics whereby when said rod member is independently supported in cantilever beam fashion at one end thereof in a vertical position and a load of one pound is applied perpendicular to said central longitudinal axis thereof at a point thereon six feet from said supported end, said rod member deflects between one inch and thirty inches at said point of application of said one pound load.

The present invention may also comprise a portable lacrosse practice goal assembly comprising: a net adapted to be vertically supported in a planar configuration between two vertical post members; a first and second post member connected to said net at first and second lateral side edges thereof; said first and second vertical post members each having a central longitudinal axis and having flexural characteristics whereby when one of said post members is independently supported in cantilever beam fashion at one end thereof in a vertical position and a load of one pound is applied perpendicular to said central longitudinal axis thereof at a point thereon six feet from said supported end, said post member deflects between one inch and thirty inches at said point of application of said one pound load; anchor means removably connectable to said post members for anchoring said first and second post members to a base surface; said anchor means comprising: a first elongate block member having a post-receiving bore therein adapted to receive a post member in close-fitting relationship; and anchor members removably connecting said first elongate block member to said base surface; said anchor means comprising a second block member of mirror image construction to said first block member; a first cross member connected at a first end thereof to an upper end of said first post member by a first flexible joint member and connected at a second end thereof to an upper end of said second post member by a second flexible joint member; said cross member being connected to a top edge of said net; a second cross member having a first end adapted to be received in said transverse bore in said first block member and a second end adapted to be received in a transverse bore in said second block member; and cord means for preventing vertical displacement of said net means connected to lower ends of said first and second post means and connected to a bottom edge of said net.

BRIEF DESCRIPTION OF THE DRAWING

An illustrative and presently preferred embodiment of the invention is shown in the accompanying drawings in which.

DETAILED DESCRIPTION OF THE INVENTION

Figure 1:
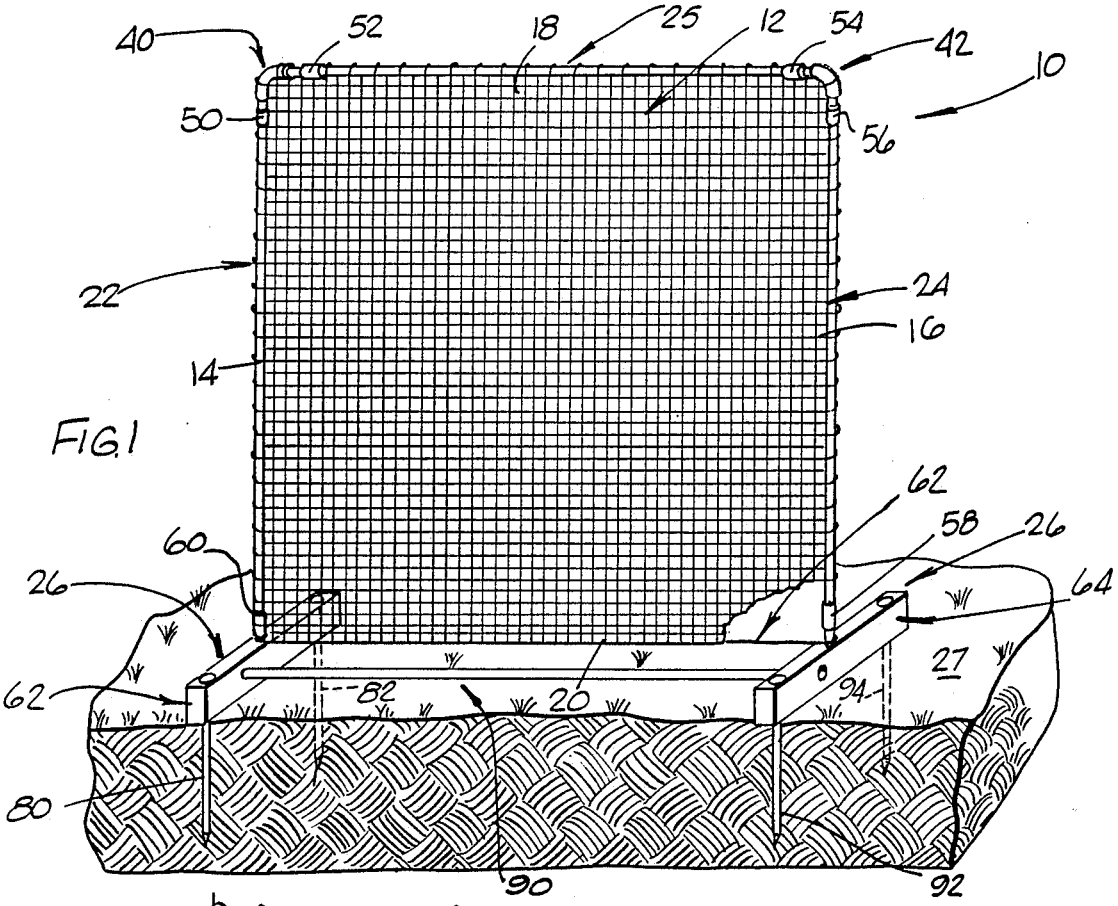
FIG. 1 is a perspective view of a lacrosse practice goal assembly.
Figure 2:
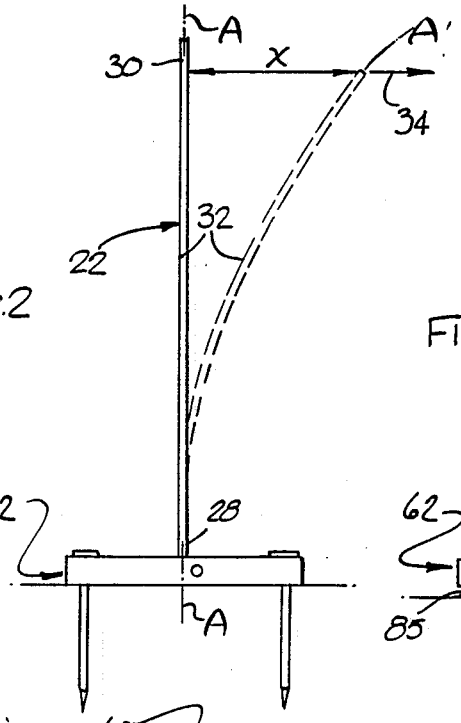
FIG. 2 is an elevation view of a post member of a lacrosse practice goal assembly which is independently supported in cantilever beam fashion in a base block.

FIG. 1 illustrates a lacrosse practice goal assembly 10 which in general comprises a generally planar, vertically disposed net 12 having a first lateral side edge 14, a second lateral side edge 16, a top edge 18, and a bottom edge 20; a first vertically disposed post member 22 for supporting the net 12 at its first lateral side edge 14; a second vertically disposed post member 24 for supporting the net at its second lateral side edge 16; and an anchor assembly 26 for anchoring the first and second post members to a base surface such as the ground 27. As best illustrated in FIG. 2, each post member 22, 24 may comprise an elongate rod having a central longitudinal axis AA and having a first end 28 and a second end 30. As illustrated in FIG. 2, flexural characteristics of members 22, 24 may be measured by independently mounting each member, e.g. 22, in cantilever fashion (i.e. immobilizing one end 28 thereof) in a stationary reference such as a base block 62 described in further detail below. The flexural characteristics of post members 22 and 24 are such that when a static load 34 of one pound is applied thereto perpendicular to axis AA at a point 32 thereon positioned six feet from the supported end 28 thereof, the rod member elastically deflects a distance x from its original unloaded position. This distance of deflection, x, is preferably between one inch and thirty inches, and is more preferably between two inches and fifteen inches and most preferably approximately six inches. Having thus described the invention in general, certain features of the invention will now be described in detail.

Net 12 is preferably a white, knotless, nylon (or other plastic) net having 45-1.75 inch squares to a side. The net is supported by first, second and third post member 22, 24, 25 which may each have the flexural characteristics described above with reference to FIG. 2. Each post member 22, 24, 25 may be 6 feet in length and may comprise a fiberglass rod having a diameter which is preferably between $\frac{1}{4}$ inch and 1 inch. The more preferred diameter range of the post members is $\frac{3}{8}$ inch to $\frac{3}{4}$ inch, and the most preferred diameter of the post members is approximately $\frac{1}{2}$ inch, the above-described rod diameters being for rods having a modulus of elasticity of between 5 and $6\times10^6$ psi and having a modulus of flexure of between 5 and $6\times10^6$ psi.

The first post member 22 is woven through alternating net squares at the first lateral edge 14 of net 12, the second post member is woven through alternating squares at the second lateral edge 16 of the net 12, and the third post member 25 is woven through alternating squares at the top edge 18 of the net 12. After each of the posts is woven through the net, the upper ends of the first and second post members 22, 24 are connected to the ends of the third post member 25 by flexible connecting means such as $\frac{1}{2}$-inch i.d., $\frac{5}{8}$-inch o.d., 3-inch-long vinyl tubing sections 40, 42 which receive ends of the post members in tight-fitting relationship therewithin. After attachment of the post members to the vinyl tubing sections, the net 12 is secured proximate corner portions thereof to the first, second and third post members by vinyl tape applied to the net and post members as illustrated at 50, 52, 54, 56, 58, and 60. The vinyl tape and post members 22, 24, 25 are preferably the same color, which is most preferably bright red-orange. A cord 62, which is preferably a 3/32-inch nylon cord, having a length approximately equal to the length of the horizontal post member 25, is connected at each end thereof to a lower end of one of the vertical post members 22, 24. Cord 62 is woven through alternating squares of the bottom edge 20 of net 12 and acts to hold the net down in situations where a ball strikes a lower portion of the net and would otherwise pass between the net and supporting base surface 27. This cord also allows the net to be folded for transportation and storage.

The three post members 22, 24, 25 joined by tubing sections 40, 42 and the attached net 12 and nylon cord 62 form a net assembly which may be collapsed into a compact unit by folding the three rod members into parallel adjacent relationship and thereafter wrapping the net 12 and attached cord 62 around the three post members.

Figure 6:
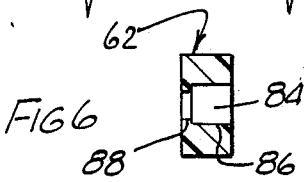
FIG. 6 is a cross sectional front elevation view of a lacrosse practice goal assembly base member.
Figure 5:
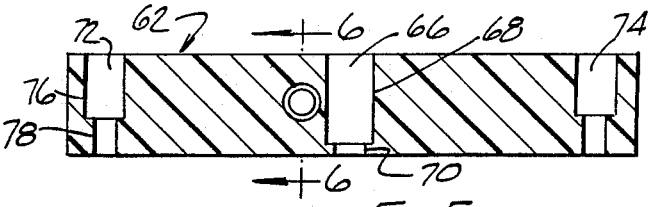
FIG. 5 is a cross sectional side elevation view of a lacrosse practice goal assembly base member.

As best illustrated by FIG. 1, anchor assembly 26, in a preferred embodiment, comprises first and second block members 62, 64 which may be, e.g., 12 inches long, 1.5 inches high and $\frac{3}{4}$ inch thick and which may be formed from high-density polyethylene plastic which is preferably white in color. As illustrated in FIGS. 5 and 6, first block member 62 may comprise a centrally positioned post-receiving bore 66 extending therethrough having a large diameter portion 68 which may be, e.g., 0.502 inch in diameter and a small diameter portion 70 which may be, e.g., 7/16 inch in diameter and which may have an axial length of $\frac{1}{8}$ inch. Post-receiving bore 66 is adapted to receive first post member 22, which may have a diameter of 0.5 inch, in close-fitting relationship therewith. First block member 62 also comprises forward and rear spike-receiving bores 72, 74 extending therethrough. Each spike-receiving bore may have a large diameter portion 76 which may be, e.g., 27/64 inch in diameter and a small diameter portion 78 which may be, e.g. 0.377 inch in diameter and $\frac{5}{8}$ inch in length. The spike-receiving bores 72, 74 may be positioned, e.g., $\frac{3}{4}$ inch from associated ends of the block member 62 and may be adapted to receive a spike, e.g. 80, 82, FIG. 1, which may have a preferred length of 10 inches and which may have a shaft diameter of $\frac{3}{8}$ inch. It has been discovered that, if the diameter of smaller sections 78 is greater than about 0.002 inch larger than the diameter of an associated spike shaft, the base member tends to work itself free from the ground after a short period of use; whereas, if the difference in the diameters is about 0.002 inch or less, the spikes tend to remain firmly anchored in the ground.

Figure 3:
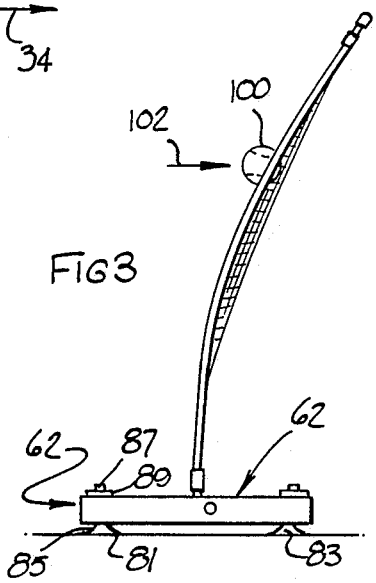
FIG. 3 is a side elevation view of a lacrosse practice goal assembly which has been flexed rearwardly by a lacrosse ball.
Figure 4:
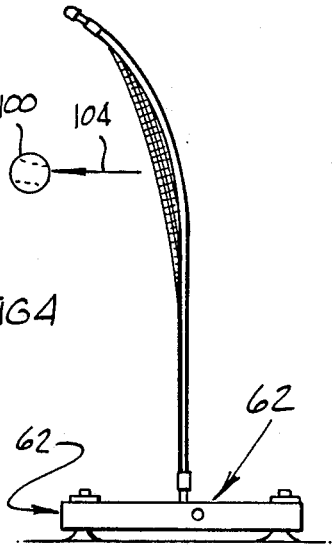
FIG. 4 is a side elevation view of the lacrosse practice goal assembly of FIG. 3 which has been flexed forwardly in a recoiling response to the lacrosse shot illustrated in FIG. 3.

In an alternative embodiment of the invention, as illustrated in FIGS. 3 and 4, spike members 80, 82 may be replaced by suction cup assemblies 81, 83 which may each comprise a suction cup 85 mounted on a bolt member 87 which is secured in position on block 64 as by a nut 89.

As illustrated in FIG. 6, first block member 62 may further comprise a transverse bore 84 extending therethrough which may have a large diameter portion 86 which may be 0.502 inch in diameter and a small diameter portion 88 which may be 7/16 inch in diameter and which may have an axial length of $\frac{1}{8}$ inch. Bore 84 is adapted to receive one end of a lower base rod 90 which may be identical in material and diameter to the first, second and third post members 22, 24, 25 and which may have a length of six feet. Second block member 62 may be identical in construction to first block member 62 except that the bores therein are provided in mirror-image relationship with respect to the bores in the first block member 62, the bores provided therein being adapted to accept second post member 24, spikes 92 and 94, and a second end of lower base rod 90. Thus, base assembly 26 comprises first and second block members 62, 64, spikes 80, 82, 92 and 94, and lower base rod 90. For transportation and storage, these individual components may be disassembled and, prior to winding the net about the folded rod members 22, 24, 25, may be laid adjacent thereto so as to be bound against the post members 22, 24, 25 when the net 12 is wound thereabout.

Thus, it will be appreciated that the lacrosse practice goal assembly 10 is an assembly which may be conveniently transported and/or stored in a relatively compact space when not in use and which may be quickly and easily erected simply by inserting ends of vertical posts 22 and 24 and lower base rod 90 in associated bores in first and second block members 62, 64 and thereafter securing the block members to the ground with spikes 82, 84, 92, 94. For indoor use, four suction cup assemblies (only two shown) 81, 83 are substituted for spike members 80, 82, 92, 94.

Lacrosse practice goal assembly 10 may be used to practice a number of lacrosse skills. In one mode of use, a lacrosse player stands at a selected position opposite one side of the net and practices goal shots by throwing a lacrosse ball into the net. The flexural characteristics of vertical post members 22, 24 are such that the post members deflect a substantial distance, e.g. 1 foot, rearwardly, as illustrated in FIG. 3, in response to the momentum of a lacrosse ball 100 thrown in direction 102. The post members thereafter whippingly recoil in the opposite direction, as illustrated in FIG. 4, throwing the lacrosse ball 100 in direction 104 back towards the player. Depending upon the player's distance from the goal, he may then practice catching the lacrosse ball in the air, catching the lacrosse ball on the bounce, or scooping the lacrosse ball from the ground as it rolls towards him. It will be appreciated that this is a significant improvement over practicing goal shots with a regular lacrosse net which does not return a lacrosse ball in any manner.

It has been discovered that the described lacrosse practice goal assembly 10 is also indicative of the strength and centering of a goal shot in that the goal assembly 10 tends to return balls with a velocity which is proportionate to the velocity with which the ball was received and which is also proportionate to the relative centering of the shot on the net. Thus, the goal assembly 10 net is ideally suited constructed for "shooting" contests between individuals in which the strength and accuracy of a shot is measured by the distance which the practice goal assembly returns the shot.

Another skill required of lacrosse players is generally referred to as "feeding" in the sport. In an actual match, a lacrosse goal is often scored by a player running or standing in front of the net who receives a ball which is passed or "fed" to him by a team member standing several feet behind the lacrosse goal. Two players may develop such feeding and shooting skills using the lacrosse practice goal assembly 10. The two individuals position themselves on opposite sides of the practice goal net and take turns feeding the ball to one another. A player after receiving a feed shoots the ball into the practice goal, retrieves the return, and finally feeds the ball to the second individual. The second individual then goes through the same sequence of maneuvers on his side of the net, this cycle being repeated over and over.

In another mode of operation, the lacrosse practice goal is used by a goal tender to develop his shot-blocking reflexes. A lacrosse goal tender in a match stands in front of the goal opening and uses his entire body and his lacrosse stick to block shots on the goal. In order to develop a goal tender's reflexes, a goal tender stands on one side of the lacrosse practice goal assembly 10 and another individual stands on an opposite side of the lacrosse practice goal assembly and shoots shots into various portions of the net 12. The goal tender moves so as to position his body in the line of the oncoming shot but is prevented from being struck with force or injured by the lacrosse ball by the net 12. The rearward sloping net construction of a conventional lacrosse goal assembly prevents its use in this manner.

As a final example, the lacrosse goal may be used by two individuals both standing on the same side of the net who alternate shooting the lacrosse ball into the net and catching its return.

It has been discovered that the vertical post flexure parameters described above provides sufficient flex to dissipate energy from the lacrosse ball to prevent damage which might otherwise occur to a relatively lightweight planar net configuration, and yet provides sufficient recoil force to return the lacrosse ball in the direction from which it was shot with substantial velocity. If the flexural characteristics of the post members 22, 24 are too low or too high, the lacrosse ball simply falls straight to the ground after being shot into the net and, in the case of post members which are too stiff, the ball may rupture the net unless an extremely heavy net is provided.

The described anchoring assembly 26 allows the lacrosse practice goal assembly 10 to be assembled on nearly any natural surface and also allows the assembly 10 to alternatively be set up indoors, for example on the wood floor of a gymnasium or the like.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A lacrosse practice goal assembly comprising:

(a) a generally planar, vertically disposed net having a first lateral side edge, a second lateral side edge, a top edge and a bottom edge;

(b) a first vertically disposed post means for supporting said net at said first lateral side edge thereof;

(c) a second vertically disposed post means for supporting said net at said second lateral side edge thereof;

(d) anchor means for anchoring said first and second post means to a base surface; and (e) said first and second vertical post means each comprising a rod member having a central longitudinal axis and having flexural characteristics such that when said rod member is independently supported in cantilever beam fashion at one end thereof in a vertical position and a load of one pound is applied perpendicular to said central longitudinal axis thereof at a point thereon six feet from said supported end, said rod member deflects between one inch and thirty inches at said point of application of said one pound load.

2. The invention of claim 1 wherein said deflection range is between two inches and fifteen inches.

3. The invention of claim 1 wherein said first and second post means each comprises a fiberglass rod having a diameter of between one-fourth inch and one-inch.

4. The invention of claim 1 wherein said first and second post means each comprises a fiberglass rod having a diameter of between three-eighth inch and three-fourth inch.

5. The invention of claim 1 wherein said first and second post means each comprise a fiberglass rod having a diameter of approximately one-half inch.

6. The invention of claim 1 further comprising a horizontally disposed cross member connected at a first end thereof to an upper end of said first post means and connected at a second end thereof to an upper end of said second post means; said cross member supporting said net at said top edge thereof.

7. The invention of claim 1 wherein said anchor means comprises:

a first elongate block member disposed perpendicularly to said generally planar vertically disposed net and having a post-receiving bore therein adapted to receive a post means in close-fitting relationship; and anchor members removably connecting said first elongate block member to said base surface.

8. The invention of claim 7, wherein said first block member comprises spike-receiving bores therein extending parallel to said post-receiving bore and wherein said anchor members comprise spike members receivable in said spike-receiving bores in said first block member.

9. The invention of claim 7 wherein said anchor members comprise at least one suction cup.

10. The invention of claim 7 wherein said first block member comprises a transverse bore therein disposed perpendicular to said post-receiving bore therein.

11. The invention of claim 10 wherein said anchor means comprises a second block member of mirror image construction to said first block member and further comprising a second cross member having a first end received in said transverse bore in said first block member and a second end received in a transverse bore in said second block member.

12. The invention of claim 11 further comprising cord means for preventing vertical displacement of said net means connected to lower ends of said first and second post means and connected to said net at said bottom edge thereof.

13. A portable lacrosse practice goal assembly comprising:

a net adapted to be vertically supported in a planar configuration between two vertical post members;

a first and second post member connected to said net at first and second lateral side edges thereof;

said first and second vertical post members each having a central longitudinal axis and having flexural characteristics such that when one of said post members is independently supported in cantilever beam fashion at one end thereof in a vertical position and a load of one pound is applied perpendicular to said central longitudinal axis thereof at a point thereon six feet from said supported end, said post member deflects between two inches and fifteen inches at said point of application of said one pound load;

anchor means removably connectable to said post members for anchoring said first and second post members to a base surface; said anchor means comprising:

a first elongate block member having a post-receiving bore therein adapted to receive a post member in close-fitting relationship; and anchor members removably connecting said first elongate block member to said base surface;

a first cross member connected at a first end thereof to an upper end of said first post member by a first flexible joint member and connected at a second end thereof to an upper end of said second post member by a second flexible joint member; said cross member being connected to a top edge of said net; said anchor means comprises a second block member of mirror image construction to said first block member;

a second cross member having a first end adapted to be received in said transverse bore in said first block member and a second end adapted to be received in a transverse bore in said second block member; and cord means for preventing vertical displacement of said net means connected to lower ends of said first and second post means and connected to a bottom edge of said net.

* * * * *